United States Patent [19]

Henderson

[11] 4,401,468

[45] Aug. 30, 1983

[54] PROCESS FOR REMOVING PRECIOUS METALS FROM ORE

[76] Inventor: Charles T. Henderson, 3311 W. Camelback, Phoenix, Ariz. 85017

[21] Appl. No.: 461,855

[22] Filed: Jan. 28, 1983

[51] Int. Cl.[3] ..... C01G 7/00; C01G 55/00

[52] U.S. Cl. ..... 75/105; 75/118 R; 423/30

[58] Field of Search ..... 75/105, 106, 107, 118 R, 75/101 R; 423/27, 29, 36

[56] References Cited

U.S. PATENT DOCUMENTS

| | | | |
|---|---|---|---|
| 1,119,473 | 12/1914 | Thacher | 423/27 |
| 2,143,073 | 1/1939 | Judson | 75/105 |
| 2,293,066 | 8/1942 | Lord | 75/105 |
| 3,429,694 | 2/1969 | Lower | 75/106 |
| 4,256,706 | 3/1981 | Heinen et al. | 75/105 |

*Primary Examiner*—O. R. Vertiz
*Assistant Examiner*—Robert L. Stoll
*Attorney, Agent, or Firm*—Drummond, Nelson & Nissle

[57] ABSTRACT

An improved cyanide process sprays an ore-cyanide leach solution into air at a high velocity to oxygenate the slurry and catalyze the reaction between the ore and cyanide leach solution.

1 Claim, 2 Drawing Figures

PROCESS FOR REMOVING PRECIOUS METALS FROM ORE

This invention relates to methods for extracting precious metals from oxide and sulfide ores.

More particularly, the invention relates to a cyanide metal extraction process which utilizes the pressurized amalgamation of ore slurry and air to efficiently oxidize the slurry and remove precious metals from ore contained in the slurry before substantial amounts of arsenic, antimony or stibnite are removed from the ore.

In a further respect, the invention relates to a cyanide process which extracts precious metals from ore after the ore and a cyanide leach solution have been in contact for only a relatively short period of time.

Cyanide processes for removing precious metals from ores are well known in the art. Such processes often require long periods of time to remove substantial amounts of precious metals from ore. See, for example, "Silver and Gold Recovery for Low-Grade Resources" by Gene E. McClelland and S. D Hill (*Mining Congress Journal,* May 1981); "Processing Gold Ores Using Heap Leach-Carbon Adsorption Methods" by H. J. Heinen, D. G. Peterson and R. E. Lindstrom (*U.S. Department of the Interior, Bureau of Mines Information Circular* 8770, 1978); "Recovering Gold from Stripping Waste and Ore by Percolation Cyanide Leaching" by George M. Potter (*U.S. Department of the Interior, Bureau of Mines Technical Progress Report* 20, December 1969); "Innovations in Gold Metallurgy" by G. M. Potter and H. B. Salisbury (*Presented at the American Mining Congress* 1973 *Mining Convention/Environment Show, Denver, Colo.,* Sept. 9–12, 1973); U.S. Pat. No. 3,635,697 to Scheiner, et al.; and "Pressure Stripping Gold from Activated Carbon" by J. R. Ross, H. B. Salisbury and G. M. Potter (*Presented at the AIME Annual Conference, SME Program, Chicago, Ill.,* Feb. 26–Mar. 1, 1973).

Problems which occur during the cyanidation of ore to recover gold and silver include locking of precious metals so that cyanide solutions cannot penetrate and dissolve the precious metals; the existence, or formation during leaching, of strongly adherent films on the surface of native gold and silver, inhibiting or preventing further dissolution of the metals; high cyanide consumption which is often accompanied by high lime consumption; long leach times required because of very slow reaction of precious metal minerals with cyanide; leach solution fouling, rendering it inactive for precious metal dissolution and often cauing difficulties in metal precipitation from pregnant solution; readsorption or reprecipitation of precious metal from solution after initial dissolution; and toxic arsine gas formation on precipitating precious metal from pregnant solution.

Further, prior to cyanidation, ores must be oxidized. Such oxidation is often accomplished with chlorine or a hypochlorite. See U.S. Pat. No. 3,639,925 to Scheiner, et al.; "Extraction of Gold from Carbonaceous Ores: Pilot Plant Studies" by B. J. Scheiner, R. E. Lindstrom, W. J. Guary and D. G. Peterson (U.S. Department of the Interior, *Bureau of Mines Report of Investigations* 7597, 1972); "Oxidation Process for Improving Gold Recovery from Carbon-Bearing Gold Ores", by B. J. Scheiner, R. E. Lindstrom and T. A. Henrie (U.S. Department of the Interior, *Bureau of the Mines Report on Investigations* 7573, 1971). Problems that can occur during chlorine oxidation of ore include high chlorine consumption, particularly if substantial quantities of sulfide are present; high lime consumption, which is related to the high chlorine consumption since oxidation of sulfide results in the formation of sulfuric acid which consumes lime, solubilization of ore components by chlorine which fouls the leach solution and causes difficulties in the precipitation of precious metals; and the dissolution of base metals by chlorine, which cements the metals out of solution during zinc precipitation and causes difficulties in obtaining acceptable dore fineness when refining the precipitate. See "Gold and Silver Extraction from Sulfide Ores" by Richard Addison (*Mining Congress Journal, October* 1980).

Amalgamation, roasting, gravity separation, fire refining and smelting techniques are also utilized to separate gold from ores.

In accordance with the invention, I have now discovered an improved cyanide leach processs for removing precious metals from ores. My new method minimizes the time during which ore must be contacted with a cyanide leach solution and removes substantial amounts of precious metals from ore without, at the same time, removing large amounts of arsenic, antimony or stibnite from the ore.

In order to extract precious metals from ore without simultaneously removing substantial amounts of arsenic, antimony or stibnite, I deliberately adjust process conditions to insure that ore and cyanide leach solution are maintained in contact for a minimal period of time and are thoroughly amalgamated with air, and, to insure that sufficient kinetic energy is imparted to the ore and the leach solution to promote the formation of "activation complexes" during the chemical reactions which extract precious metals from the ore.

To achieve these process conditions, I combine comminuted ore and an aqueous leach solution of calcium carbonate in a stirred reaction vessel. Cyanide is added to the solution after the pH of the lime-ore slurry stabilizes at 10–11. The pH of the lime-ore slurry usually stabilizes in the range of 10 to 11 approximately five to thirty minutes after the ore has been contacted with the leach solution. Caustic soda or borax may be utilized in place of lime in the aqueous leach solution.

After cyanide has been added to the ore-leach solution mixture, the resulting extraction mixture slurry is pumped into a conduit and through a spray nozzle centrally positioned inside a bell-shaped reaction vessel. Compressed air is forced into the extraction mixture slurry before the slurry reaches the spray nozzle. The compressed air causes the slurry to explode upwardly from the spray nozzle and drive against the top of the bell vessel. The velocity of the stream of slurry upwardly flowing from the nozzle forms partial vacuum areas near the nozzle. Air flowing into these partial vacuum areas tends to draw slurry deflected from the top of the vessel back toward the nozzle, increasing the turbulence inside the vessel and more effectively intermixing air and slurry. Slurry sprayed from the nozzle and deflected downwardly from the roof of the bell vessel eventually settles in the bottom of the vessel and is drawn from the bottom of the vessel. Slurry drawn from the bottom of the vessel is either recycled back through the slurry pump into the bell container or is directed to a processing station where the ore tails and other solids are separated from the aqueous leach solution. Separated aqueous leach solution is processed to remove precious metal values therefrom.

For certain ores a single pass of the cyanide extraction mixture slurry through the bell reaction vessel is sufficient to extract a substantial portion of the precious metals contained in the ores. For other ores, recycling of the cyanide extraction mixture slurry through the bell-shaped container is preferably continued for fifteen minutes or longer in order to extract the desired quantities of precious metals from the ores.

Prior to being slurried with primary lime leach solution, raw ore is washed to remove shale, dirt and other gangue and is crushed to particles approximately one-half inch in size. These particles are then fed into a ball mill for further reduction to 100 mesh particles. Fine grinding of the ore is desired because it facilitates rapid interaction between precious metal compounds contained in the ore and chemicals in the leach solution. However, grinding the ore into particles of smaller size than 100 mesh is presently not preferred because of the increased difficulty of separating the fine particles from the leach solution after the slurry has been amalgamated with air in the bell-shaped reaction vessel.

Ground ore and primary lime leach solution are presently combined at room temperature. After cyanide is mixed with the ore-lime slurry and the slurry directed into the bell-shaped container, the temperature of the slurry presently appears to stabilize at about 60° C. Although the cyanide-lime leach solution will extract precious metals from ore at lower and higher temperatures, the leach process of the invention appears to function efficiently without having to provide supplemental heat during the process.

The process of the invention has extracted over 90% of precious metals contained in an ore while requiring that the comminuted ore remain in contact with the lime-cyanide leach solution for a period of time much shorter than the ore-leach solution reaction time required for conventional cyanide leaching procedures.

Although I am not certain of the exact interactions taking place between the ore-lime-cyanide slurry and air in the bell reaction vessel, an explanation of the unexpected efficiency of the process of the invention may be found in the collision theory of chemical kinetics and the theory of interaction between a liquid-solid spray and a gaseous atmosphere.

Oxygenation of ore-leach solutions is notoriously old. However, oxygenation is normally accomplished by bubbling compressed air into a leach solution-ore slurry. This is an inefficient method of oxidation because the primary contact between oxygen and ore in the slurry only takes place at the interface between the slurry and surface of each bubble of air. In addition, the individual bubbles only have a relatively small amount of kinetic energy. The process of the invention is believed to be markedly more efficient in oxygenating the extraction mixture slurry because the slurry is charged with compressed air, exploded into a gaseous atmosphere at a high rate of speed, directed against and deflected from a rigid surface, and thoroughly intermixed with air. The high velocity of the slurry spray as it passes through air in the bell container fuels the spray with a large amount of kinetic energy. The high kinetic energy of individual spray particles facilitates substantial increases in the potential energy of air, ore, lime and cyanide molecules when they collide. Substantial increases of potential energy on the collision of particles provides the activation energy necessary to cause chemical interactions between the molecules which extract precious metals from the ore. In contrast, when air is bubbled through a leach solution-ore slurry, the air bubbles do not have sufficient kinetic energy.

The chemical kinetics collision theory makes the basic assumption that particles must collide for a chemical reaction to occur. The percentage of collisions which are effective in causing a particular chemical reaction to occur is termed the reaction rate. There are a number of factors which influence the reaction rates between chemical molecules or particles. One factor is the nature of the chemical reactants. The energy of activation will vary depending on the particular chemical reactants involved. Another factor is the concentration of the reactants. As the concentration of the reactants is increased the number of collisions and reaction rate increases.

Temperature is also an important factor which influences the reaction rate between chemical particles or molecules. An increase in temperature makes molecules move faster, collide more frequently, and collide with greater force. As the violence of collision increases it is more likely that potential energy necessary to cause chemical interaction between the colliding particles will be generated.

A further factor influencing the reaction rate between chemical molecules is the speed at which a fluid stream containing one (or both) of a pair of chemical reactants is moving through another body of fluid containing another (or both) of the chemical reactants. A fast moving stream of fluid imparts kinetic energy to particles in the stream. This kinetic energy is converted into potential energy when chemical reactants in the stream of fluid collide with chemical reactants in the body of fluid through which the stream is moving.

Finally, the presence of catalysts can be a factor in the reaction rate between chemical components. Catalysts can measurably reduce the activation energy necessary for two molecules to chemically interact on colliding with one another.

Providing reactive particles with sufficient kinetic energy is important because if the collision between two molecules is too gentle the desired chemical reaction will not occur. The colliding particles will instead separate and resume their original identities. The electron clouds associated with two different molecules often repel each other because they are similarly charged. In a gentle collision, the repulsion between the electron clouds may cause the particles to bounce apart. However, if either or both of the molecules colliding have sufficient kinetic energy, the kinetic energy may cause the molecules to penetrate each other far enough to overcome the electron repulsion and, allow electron rearrangement and a chemical reaction to take place.

The amount of energy necessary to produce a chemical reaction during a collision between two particles or molecules is called the energy of activation.

Under the absolute-reaction-rate theory, the reaction rate between colliding particles can be calculated by applying the equations of wave mechanics. To achieve a basic understanding of the absolute-reaction-rate theory, a one-step reaction will be considered in which a single molecule of chemical A collides with a single molecule of a chemical B to form one molecule each of chemicals C and D. When A and B collide a transient complex particle is formed. The complex particle, called the activated complex, either splits apart into the original A and B chemical molecules or splits in another way to give the new chemical particles C and D. The absolute-reaction-rate theory calculates the potential energy change as molecules of A and B collide to form the activated complex and then separate into C and D molecules. A typical potential-energy curve is shown in FIG. 2 of the drawings. The potential energy of the A and B molecule system is plotted on the vertical axis of the graph while how far the reaction between A and B has progressed is plotted on the horizontal axis. In the initial state of the system the A and B particles are far enough apart not to affect each other and the potential energy in the system is the sum of the potential energy of B and of the potential energy of A. As A and B approach each other and begin to collide, the electron clouds of A and B repulse one another. In order to force the A and B particles together additional work must be done on A or B or both. When this supplemental work is done on the A, B system, the potential energy of the system increases. The potential energy continues to increase until the activated complex is formed. The activated complex then splits apart into C and D molecules. The potential energy of the system decreases as the activated complex splits into C and D particles.

Figure 2:
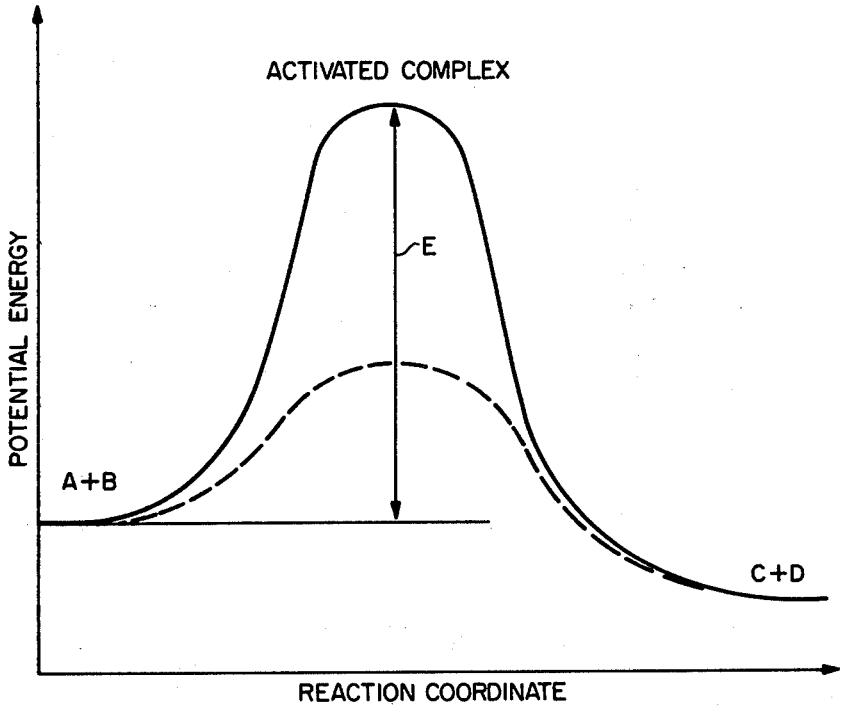
FIG. 2 shows a typical potential-energy curve with the A and B molecule system being plotted on the vertical axis and the reaction progression being plotted on the horizontal axis.

The difference indicated by arrow E in FIG. 2 between the potential energy of the initial state of A and B and the potential energy of the activated complex is a measure of the energy which must be added to the A and B particles in order for them to react. This difference between the potential energies of the initial state of A and B and the activated complex is the activation energy of the reaction. The activation energy is normally supplied by converting some of the kinetic energy of A and B particles into potential energy. If the A and B particles have minimal amounts of kinetic energy, all of the kinetic energy of the A, B pair may, when A and B collide, be converted into potential energy without the formation of the activated complex. When the activated complex is not formed, A and B separate unchanged. If the A and B particles have enough kinetic energy, the activated complex forms when A and B collide and the complex splits into the chemical molecules C and D.

The absolute-reaction-rate theory indicates why the bell spray chamber of the apparatus of the invention successfully removes precious metals from ore at substantially greater rates than prior art cyanide leaching procedures. The high rate of travel of slurry sprayed into the bell chamber provides slurry particles with high kinetic energy so that when spray particles collide with oxygen molecules in the air in the bell chamber sufficient potential energy is generated to produce activated complexes. Directing the slurry spray stream against the roof of the bell-shaped chamber further assists in the production of potential energy.

The rapid movement of slurry spray through air in the bell reaction chamber is also believed to produce ozone, a very strong oxidizing agent, and other charged particles which assist, possibly as catalysts, in the reactions between the cyanide, lime and ore.

Placement of the slurry spray nozzle away from the inner walls and toward the center of the bell chamber assists in the amalgamation of slurry and compressed air since the velocity of fluid sprayed from the nozzle causes the formation of partial vacuums near the nozzle. These partial vacuums cause, along with the slurry spray stream, circulation of air and spray in the reaction chamber and promote the amalgamation of slurry and air.

Impinging the sprayed slurry stream against the roof of the reaction chamber is an important feature of the apparatus. When the spray stream flows against the reaction chamber roof, molecules in the spray stream collide and are temporarily compressed against one another, facilitating the interation between cyanide, oxygen, ore, and other charged particles in the reaction chamber.

Figure 1:
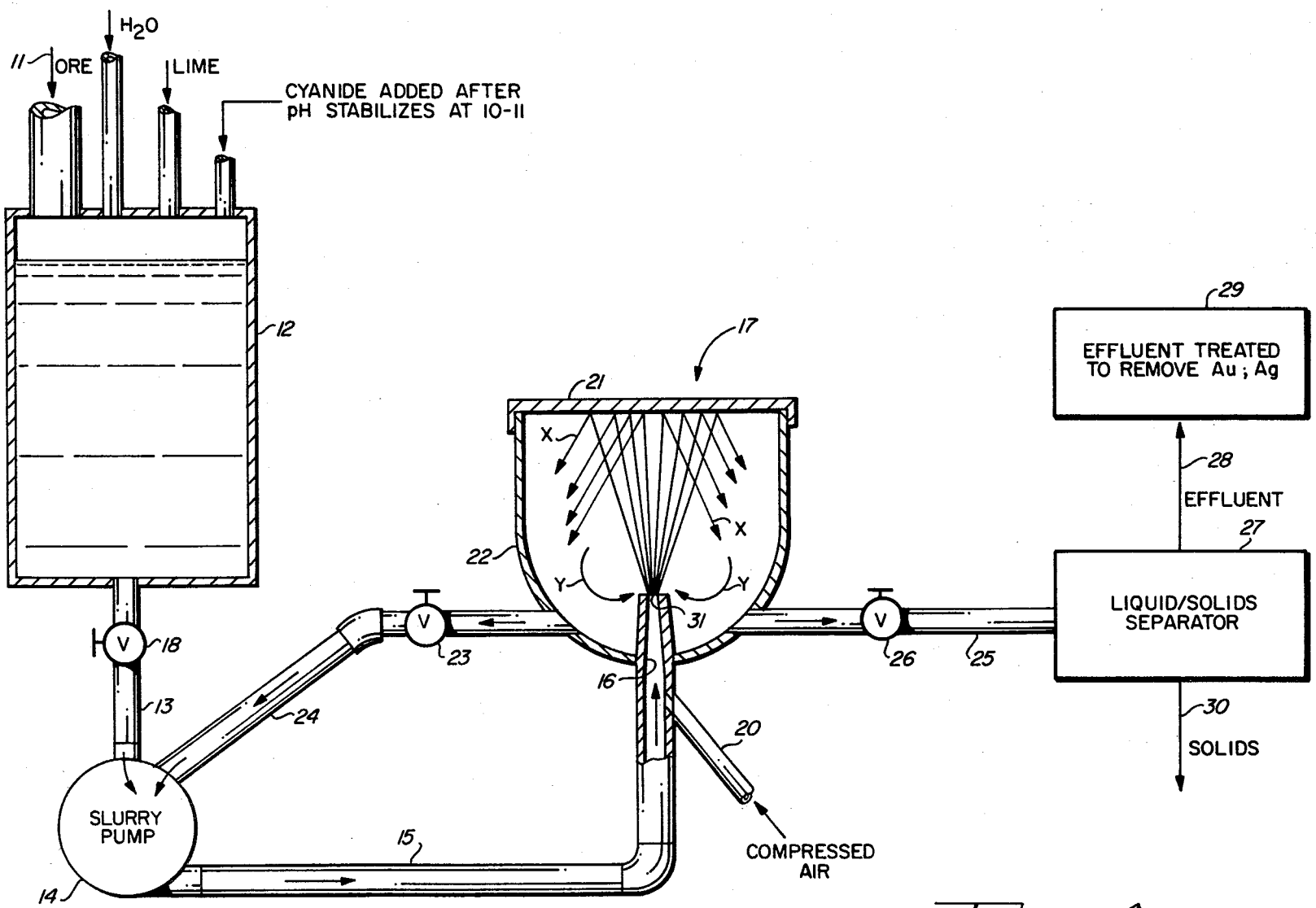
FIG. 1 depicts an overall integrated process for extracting precious metals from ores.

FIG. 1 illustrates an overall integrated process for extracting precious metals from ores. Raw comminuted ore 11, water, and lime are combined in stirred tank 12. Cyanide is added to tank 12 after the pH of the ore-lime slurry has stabilized at 9–12. Presently about 3 to 4 pounds of water is added to tank 12 for every pound of comminuted ore. Five to eight pounds of lime are added to tank 12 per ton of ore. For each ton of ore-lime leach solution approximately one to one and a half pounds of cyanide are used. The quantities of the various chemicals can, of course, be varied as desired.

After cyanide has been sufficiently mixed with the ore-lime-water solution to form an extraction mixture slurry, the extraction mixture slurry is drawn through opened valve 18 of conduit 13 by pump 14 and directed through conduit 15 and venturi spray nozzle 16 into bell-shaped reaction vessel 17. Compressed air is added to the stream of extraction mixture slurry via conduit 20. Venturi spray nozzle 16 and the compressed air cause the extraction mixture slurry to burst into reaction chamber 17. Spray, indicated by arrows X, from nozzle 16 upwardly impinges against the undersurface of lid 21 and is downwardly deflected toward the bottom of bowl 22. Partial vacuum areas which form near the stream of slurry from nozzle 16 tend to draw spray downwardly deflected from lid 21 back toward nozzle 16. Deflected spray drawn toward nozzle 16 by the partial vacuum areas tends to again be drawn upwardly toward roof 21 by the rapid upward flow of spray from nozzle 16. This circular motion of spray, indicated by arrows Y, promotes thorough amalgamation of air and slurry particles. Oxygenated, reacted slurry which accumulates in the bottom of bell chamber 17 can be recycled through open valve 23 in conduit 24 to pump 14 and back through conduit 15 to reaction chamber 17, or, some or all of the slurry which accumulates in the bottom of chamber 17 can be drawn by a pump (not shown) through conduit 25 and opened valve 26 therein to a liquid-solids separator 27. Aqueous solution 28 from separator 27 is treated 29 to remove precious metals therefrom. Ore tailings 30 are discarded or recycled.

Opening 31 of the presently preferred nozzle 16 is three-quarters of an inch in diameter. Slurry is pumped through mouth 31 of nozzle 16 at approximately 150 gallons per minute. As earlier discussed, this high speed of travel of the slurry into reaction vessel 17 is important in connection with the development of potential energy and charged particles which promote the interaction of the chemical components in the slurry to extract precious metals from the ore.

The following examples are presented, not by way of limitation of the scope of the invention, but to illustrate to those skilled in the art the practice of various of the presently preferred embodiments of the invention and to distinguish the invention from the prior art.

EXAMPLE 1

A sample of carbonaceous ore from the Silver Ridge mine in Arizona was obtained. The ore contained iron, manganese, silica, aluminum and lead. There were 0.04 oz/ton of gold and 12 oz/ton of silver in the ore.

One hundred and twenty-five pounds of ore was ground to 100 mesh and then mixed in a stirred reaction vessel at room temperature and atmospheric pressure with a leach solution which included 250 pounds of water and 0.5 pounds of lime.

The ore-leach solution extraction mixture slurry was mixed in the reaction vessel until the pH of the extraction mixture slurry stabilized at 10–11. When the pH of the extraction mixture has stabilized, approximately 0.1 pounds of cyanide was added to the slurry. After the cyanide was mixed into the extraction mixture slurry for approximately 5 minutes, the extraction mixture slurry was pumped from the reaction vessel to a bell-shaped container similar to container 17 of FIG. 1 of the drawings.

The cyanide extraction mixture slurry was pumped at a rate of 12,000 gal/hr into bell vessel 17 through a nozzle 31 having a ¾" ID. Pump 14 forced slurry through conduit 15 into bell vessel 17 under a pressure of about 35–45 psi. Compressed air was introduced into conduit 15 from conduit 20 at a pressure of 35–45 psi. The pressure of the compressed air was kept equivalent to the pressure of the slurry in conduit 15. If the pressure of the compressed air exceeds that of the slurry, the compressed air tends to cause the slurry to back up in conduit 15. If the pressure of the compressed air is less than that of the slurry, the slurry tends to be forced out through conduit 20.

The high rate of travel of the cyanide extraction mixture slurry as it entered vessel 17 and interacted with air in the vessel caused the temperature of the slurry to increase from room temperature to about 60° C.

After the cyanide extraction mixture slurry had flowed through nozzle 16 into bell vessel 17, the slurry was twice recycled through conduit 24, pump 14 and conduit 15 back to bell vessel 17.

After being recycled twice through vessel 17, the extracted ore was separated from the cyanide leach solution. The leach solution and ore were analyzed. Ninety-one percent of the gold and silver had been extracted from the ore into the leach solution.

EXAMPLE 2

A sample of limestone-quartz-zinc ore from the Alamos mine in Mexico was obtained. The ore contained approximately 32 oz/ton of silver and 0.03 oz/ton of gold. The ore was treated utilizing the process described in Example 1. Approximately 90 percent of the gold and silver in the ore was extracted into the cyanide leach solution.

EXAMPLE 3

A quartz-iron ore from Arizona was obtained. The ore contained approximately four oz/ton of gold. The ore was treated utilizing the process described in Example 1. Approximately 90 percent of the gold and silver in the ore was extracted into the cyanide leach solution.

In utilizing the process of the invention as described in the foregoing examples, I have found that when the ore-leach solution extraction mixture slurry is formed, a ratio of water to ore of from 1:1 to 5:1 is normally satisfactory and that the amount of lime or caustic soda utilized usually is about from one to ten pounds per ton of ore. In addition, the amount of cyanide utilized is usually from one to eight pounds per ton of ore. If an ore contains copper or zinc, greater amounts of cyanide are required. The necessary amounts of lime, water and cyanide required for a particular ore can, assuming an understanding of the prior art, be readily determined with minimal experimentation.

The time required for the pH of the extraction mixture slurry to stabilize when comminuted ore is initially combined with water and lime typically varies from five to sixty minutes.

I have also utilized the apparatus of the invention to leach gold, silver and other metals from manganese ore by using an aqua regia-sulfuric acid leach solution.

As earlier noted, the extraction mixture slurry can be formed at any temperature above the freezing point of the extraction mixture slurry. However, forming the extraction mixture slurry at room temperature and then directing the slurry into reaction vessel 17 at room temperature appears to result in substantial extraction of precious metals from most ores.

As would be appreciated by those of skill in the art, the temperatures or pressures maintained during formation of the extraction mixture slurry in tank 12, injection of the extraction mixture slurry into tank 17, liquid-solids separation step 27, or precious metals removal step 29 can be varied and/or maintained at any level(s) desired in view of the prior art and in view of chemical reagents or processes employed during these steps. Ordinarily, the temperatures maintained during each of the steps 16, 18, 25, etc. in a treatment process will not, of course, be equivalent.

Formation of the extraction mixture slurry in tank 12 and spraying of the extraction mixture slurry into tank 17 currently generally takes place at atmospheric pressure.

Having described my invention in such terms as to enable those skilled in the art to which it pertains to understand and practice it, and having described the presently preferred embodiments thereof,

I claim:

1. A process for removing precious metals from comminuted ores, comprising the steps of:

(a) contacting said comminuted ore with an effective amount of a basic aqueous solution to effect a stabilized pH of 10 to 11;

(b) allowing the pH of the ore-basic ore-aqueous solution mixture to stabilize;

(c) mixing cyanide in the stabilized ore-aqueous solution mixture to form an extraction mixture slurry;

(d) spraying said extraction mixture slurry through at least one nozzle into an air atmosphere and deflecting said sprayed slurry back toward said nozzle;

(e) separating said sprayed slurry into a liquid and solid component; and (f) processing said liquid component to remove precious metals therefrom.

* * * * *